United States Patent [19]
Hunter et al.
[11] 4,444,087
[45] Apr. 24, 1984

[54] MISSILE CONTAINER AND EXTRACTION MECHANISM

[75] Inventors: Alex B. Hunter; George T. Pinson, both of Huntsville, Ala.

[73] Assignee: The Boeing Company, Seattle, Wash.

[21] Appl. No.: 343,540

[22] Filed: Jan. 28, 1982

[51] Int. Cl.³ ..... F41F 3/04

[52] U.S. Cl. ..... 89/1.802; 89/1.811; 89/1.813; 89/1.815; 89/1.819

[58] Field of Search ..... 89/1.8, 1.801, 1.802, 89/1.804, 1.811, 1.813, 1.815, 1.816, 1.817, 1.819; 244/3.28

[56] References Cited

U.S. PATENT DOCUMENTS

| | | | |
|---|---|---|---|
| 2,735,391 | 2/1956 | Buschers | 89/1.802 |
| 3,098,445 | 7/1963 | Jackson | 244/3.28 |
| 3,296,927 | 1/1967 | Olsson et al. | 89/1.8 |
| 3,742,813 | 7/1973 | Kongelbeck | 89/1.817 X |
| 3,742,814 | 7/1973 | Kroh | 89/1.8 |
| 3,769,876 | 11/1973 | Haas et al. | 89/1.816 X |
| 3,893,366 | 7/1975 | Murray | 89/1.801 |
| 4,004,487 | 1/1977 | Eichweber | 89/1.815 |
| 4,296,894 | 10/1981 | Schnäbele et al. | 244/3.27 |

FOREIGN PATENT DOCUMENTS

| | | | |
|---|---|---|---|
| 1207832 | 5/1963 | Fed. Rep. of Germany | 89/1.801 |

*Primary Examiner*—David H. Brown
*Attorney, Agent, or Firm*—Edwin H. Crabtree

[57] ABSTRACT

A missile container for storing a missile therein and having an extraction mechanism for extracting the missile from the container and placing the missile in the proper launch attitude.

11 Claims, 5 Drawing Figures

MISSILE CONTAINER AND EXTRACTION MECHANISM

BACKGROUND OF THE INVENTION

This invention relates to a missile container and aunch mechanism and more particularly but not by vay of limitation to a multiple launch container having . plurality of individual missile containers having their ›wn missile extraction mechanism so that each missile :an be independently stored, extracted and placed in the ›roper attitude for launch.

Heretofore, there have been various types of missile aunch systems such as a tube launch, a rail launch and ı zero length launch. In a tube launch system, the mis- ile is ejected from a launch tube using axillary power uch as compressed gas or from the missile's prime ›ropulsion system. In any case, the missile does not :ontain sufficient velocity when exiting the launch tube o permit the aerodynamic control surfaces to be effec- ive. Therefore missile control is marginal. During this ›eriod of time the deployment and aerodynamic sur- aces can cause problems such as reverse lift with roll nstability and assymetrical control surface deployment :ausing thrust alignment problems. In addition, starting he primary propulsion system when in a launch tube :auses additional problems such as massive and second- ıry blow-by in the case of the rocket engine thrust ystem and engine aspiration problems in the case of the nternal combustion engine system.

In a rail launcher system the advantage of more accu- ·ate missile control is provided while under launch guidance. However, a rail launcher is seldom used in a nissile with any automatic flight control systems. It has he same disadvantages as a zero length launcher. The :ero length launcher poses the problem in that the en- ire missile must be placed on the zero length launcher ıfter removal from the shipping container. This system loes have the advantage of allowing the missile to be ›reset upon the launcher and starting the propulsion ystem prior to launch. This method however leaves the nissile exposed to the weather with its configuration visible prior to launch. A final disadvantage is that the nissile must be shipped and stored in a separate ship- ›ing and storage container. This method is slow and the ·ate at which missiles can be prepared and launched is imited.

These types of containers and launch mechanisms are ihown in U.S. Pat. No. 4,004,487 to Eichweber, U.S. Pat. No. 3,098,445 to Jackson, U.S. Pat. No. 3,921,937 o Voss et al, U.S. Pat. No. 3,769,876 to Haas et al, U.S. Pat. No. 3,357,305 to Clutz et al, U.S. Pat. No. 3,742,814 o Kroh and U.S. Pat. No. 4,296,894 to Schnabele et al.

None of the above mentioned patents describe the ınique structure and advantages of a missile launch :ontainer and extraction mechanism as described ıerein.

SUMMARY OF THE INVENTION

The subject invention consists of a multiple missile ihipping, storage and launch container which contains ıll of the individual mechanisms and control systems ·equired to extract a plurality of missiles from their ndividual launch containers.

An unspecified number of missiles may be placed in ndividual launch containers which are in turn placed in he multiple shipping, storage and launch container. All of the missile aerodynamic surfaces are folded to fit inside their own individual launch container. The individual launch containers protect the missiles during shipment, storage and prior to the missile being launched. The individual launch containers contain all of the mechanisms required to fuel the missile, extract the missile from the launch container, deploy and latch all missile aerodynamic surfaces and place the missile at a desired launch attitude. Further, the launch container includes the mechanism to start the main propulsion system or axillary propulsion systems on command.

The missile container and extraction mechanism for storing and extracting a missile and placing it in an attitude for launch includes an enclosed, individual missile container housing having a hinge door mounted in front of the housing. A slide assembly including a pair of slide rails are mounted on a pair of fixed rails attached to the bottom of the housing. A drive motor with an endless chain is attached to the slide rails and launch platform for sliding the slide rails and launch platform outwardly from the front of the housing. The missile is mounted on top of the launch platform. The front of the launch platform includes a cam surface which engages a pair of rollers attached to the sides of the slide rails. As the launch platform is moved forward on the slide rails the cam surface engages the rollers moving the launch platform upwardly into a proper attitude as the missile is extracted from the container housing.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
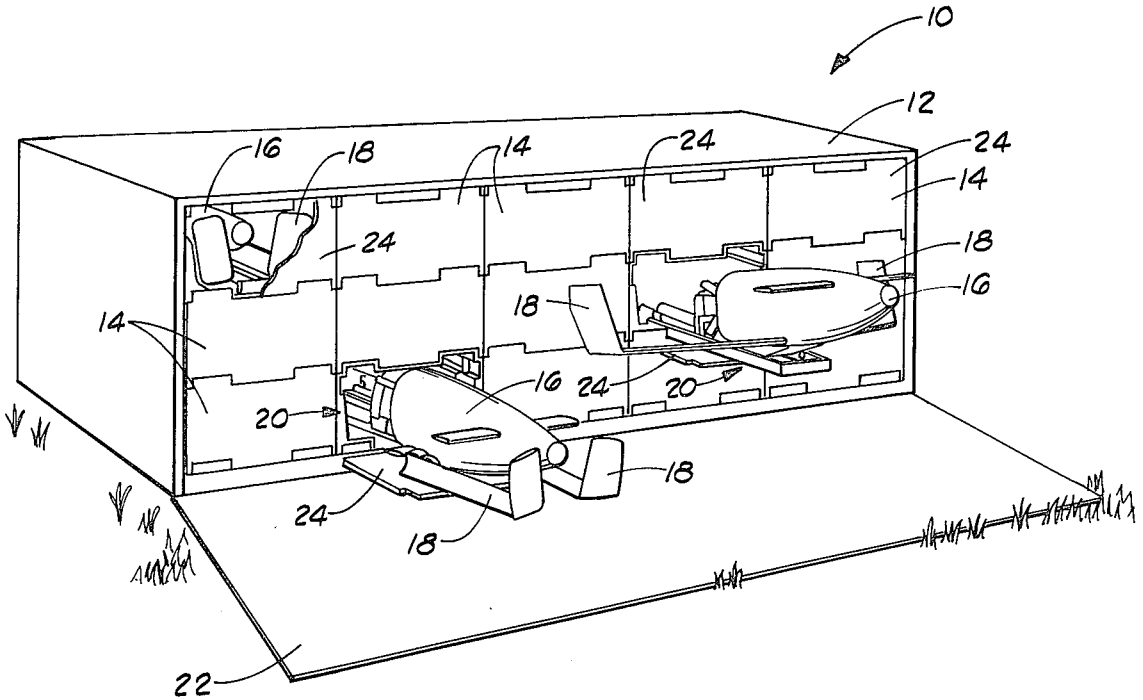
FIG. 1 is a perspective view of the front of the multiple launch container having a plurality of individual missile containers with one of the missile shown in an extracted position and another missile in a fully deployed position, ready for launch.

In FIG. 1 a front perspective view of the missile container and extraction mechanism is shown and designated by general reference numeral 10. The container 10 includes a multiple shipping, storage and launch container 12 having a plurality of individual missile container housings 14. Inside the individual housing 14 are missiles 16 having folded wings 18 and mounted on an extraction mechanism indicated by general reference numeral 20. One of the missiles 16 is shown extracted from its housing 14 with another raised in its proper launch attitude with the wings 18 unfolded.

The shipping, storage and launch container 12 includes a hinged door 22 which is lowered so individual missile container housings 14 with individual hinged doors 24 can be lowered when the extraction mechanism 20 is moved outwardly from the front of the housings 14. Also, shown in FIG. 1 is one of the individual housing doors 24 cut-away to show the missile 16 in a stored position with its wings 18 folded adjacent thereto.

Figure 2:
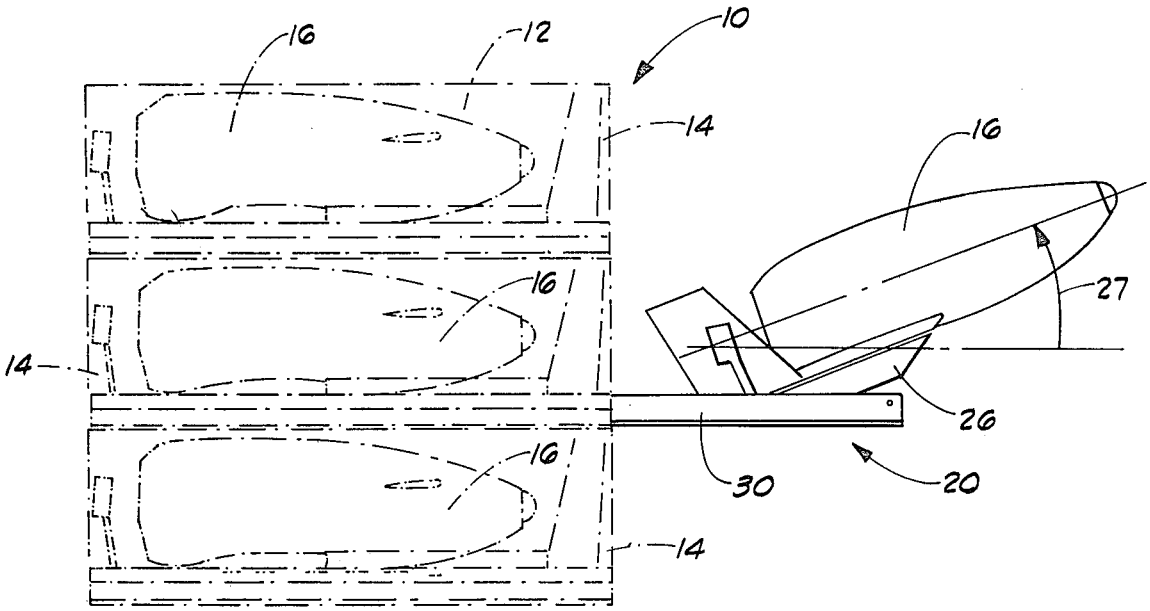
FIG. 2 is a side view of the missile container with one of the missiles in an extracted position and in a proper launch attitude.

In FIG. 2 a side view of the missile container and extraction mechanism 10 can be seen with three missiles 16 stored one on top of the other inside the container 12 and in individual housings 14. Also shown extending outwardly from the front of the container 10 is the extraction mechanism 20 having a launch platform 26 mounted thereon for placing the missile 16 in its proper launch attitude indicated by arrow 27.

Figure 3:
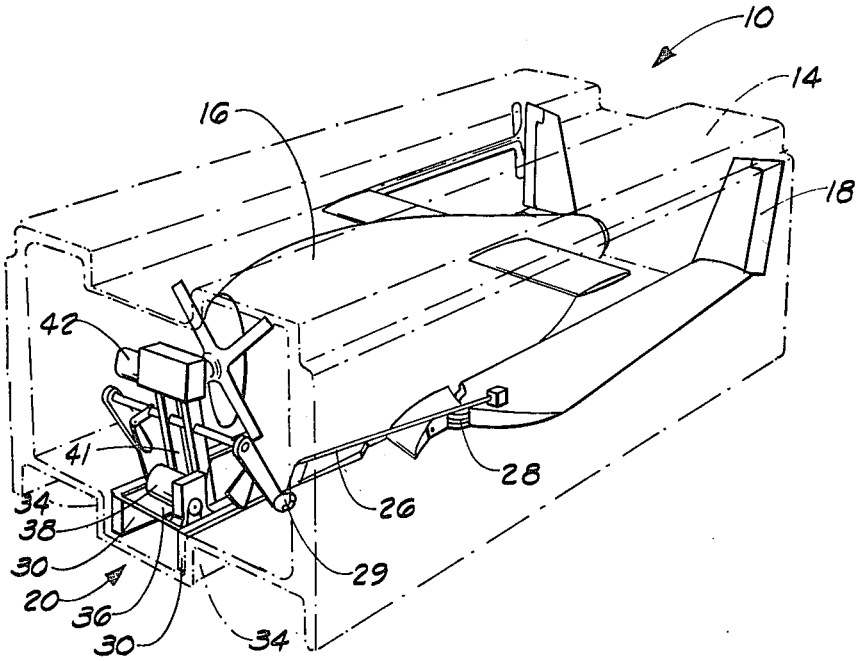
FIG. 3 is a perspective view of an individual missile container with the missile shown stored therein.

In FIG. 3 a perspective view of an individual missile container housing 14 is illustrated. In this figure the missile 16 can be seen with its wings 18 folded in a stored position. The wings 18 are hinged to the missile by wing hinges 28 and the wings 18 are attached to a releasable wing unfold mechanism 29 which is attached to the launch platform 26.

The extraction mechanism 20 further includes a slide assembly made of a pair of slide rails 30, slidably mounted on pair of fixed rails 34. Mounted on top of a slide assembly platform 36 is a slide assembly drive motor 38 which drives an endless chain 40 shown in FIG. 4 and FIG. 5. The motor 38 includes a drive sproket 39 for engaging the chain 40. The chain 40 is mounted on idle sprokets 41.

Mounted on the launch platform 26 is a launch stand 41 with a missile starter motor 42 connected to an internal clutch which is releasably attached to the missile 16 for starting the missile prior to the launching of the missile 16 from the platform 26.

Figure 4:
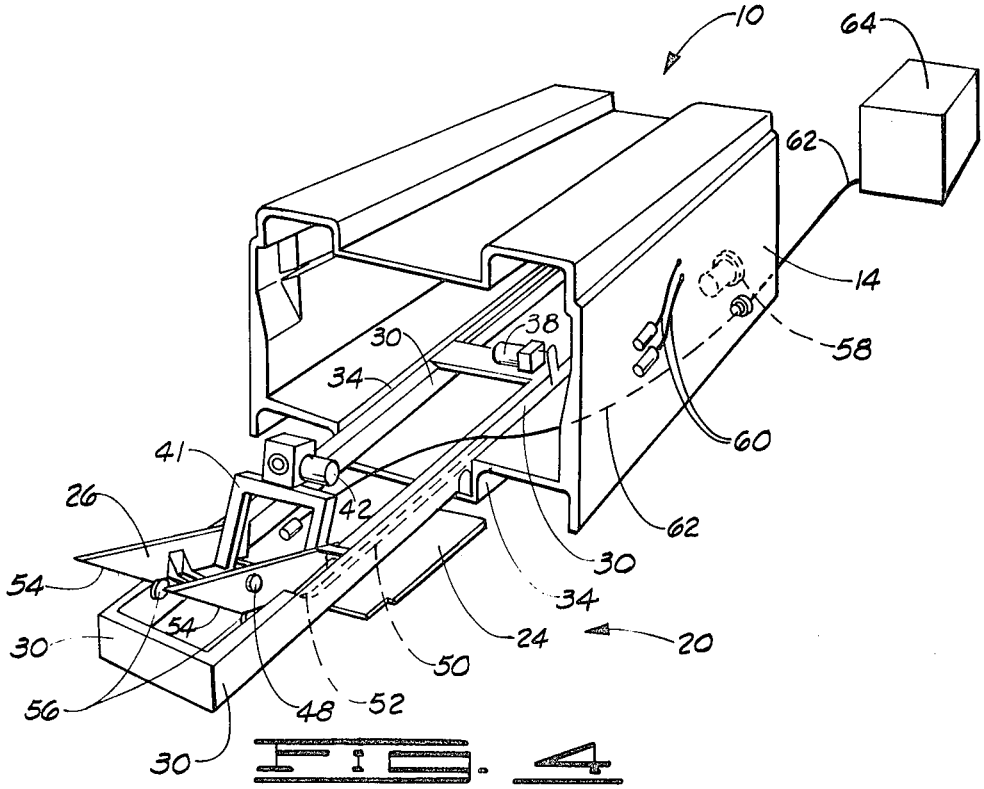
FIG. 4 is a perspective view of the extraction mechanims for receiving the missile thereon.
Figure 5:
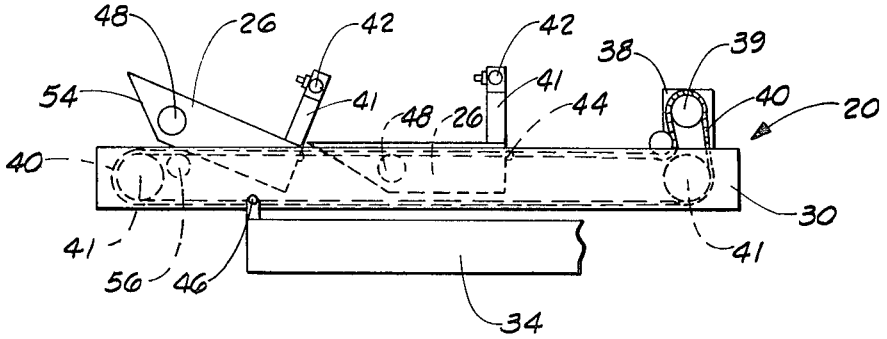
FIG. 5 is a side view of the slide assembly and launch platform.

In FIGS. 4 and 5 the extraction mechanism 20 can be seen more clearly for lowering the door 24 of the individual container 14 and placing the missile 16 in its proper attitude. It should be noted in both of these figures the missile has been removed to show the structure of the extraction mechanism 20. When a command is given to start the drive motor 38 the endless chain 40 which is connected to the launch platform at a point indicated by numeral 44 and connected to the fixed rail at a point indicated by numeral 46. When the motor is started the endless chain 40 moves the slide rails 30 along with the drive motor 38 and at the same time the launch platform 26 is moved forward on top of the slide rails 30. The opposite sides of the platform 26 include incline rollers 48 which roll on top of a roller guide 50 on the inside of the rails 30 and shown in dotted lines in FIG. 4. The guide 50 further includes an inclined surface 52 which raises the front end of the platform 26 upwardly in its extracted position after the front of the slide rails 30 has contacted the hinged door 24 and lowered it into its opened position as shown in FIG. 4. In FIG. 4 the extraction mechanism 20 is in its completely extracted position outwardly from the front of the container 14 with the platform 26 in its proper attitude.

The front of the platform 26 includes cam surfaces 54 which engage a pair of cam rollers 56 which are mounted on the inside of the two slide rails 30 and engage the cam surface 54 when the platform 26 is raised upwardly by the rollers 48 moving up the incline 52 of the guide 50. After the missile 16 has been launched a command can be given to the drive motor 38 and the endless chain 40 is reversed in direction so the platform 26 is moved rearwardly on the slide rails 30 and into its stored position inside the container 14.

In FIG. 5 a portion of the fixed rails 34 are shown and in this view the slide rails 30 can be seen extending outwardly to the left with the platform 26 angled upwardly in its proper attitude for the launch of the missile. It can be seen that the platform 26 is shown in two positions with the platform 26 to the right in its retracted position inside the container and a second position to the left wherein the cam surface 54 has engaged the cam rollers 56 and placed the platform 26 in the proper attitude.

Referring now back to FIG. 4, the container 14 can be seen with a sealed desiccant purge package 58 a fuel and vent umbilical cord 60 for fueling and properly venting the missile 16 when its in a stored position in the container 14 and a fly-away electrical unbilical cord 62 which is releasably attached to the missile 16 prior to launch.

Prior to launch, each missile 16 is provided data that defines the target coordinates or location, navigational data consisting of altitude, speed, flight profiles, winds and other dead reckoning or navigational data through the umbilical cord 62. This data defines a specific target and the manner in which that target will be attacked by each missile 16. The data is transmitted from a missile programmer and launch controller 64 through the umbilical cord 62 to each missile 16. In addition to programming each missile, the missile programmer and launch controller 64 controls the deployment, fueling and launch of each missile using preprogrammed or generated control commands.

By reviewing the above figures, the unique missile container 14 and extraction mechanism 20 for storing and extracting the missile 16 and placing the missile 16 quickly in a proper attitude and when the proper command is given launching the missile 16 from the launch platform 26 and then retracting the extraction mechanism 20 back inside the container 14 for receiving another missile and repeating the cycle.

Changes may be made in the construction and arrangement of the parts or elements of the embodiments as described herein without departing from the spirit or scope of the invention defined in the following claims.

What is claimed is:

1. A missile container and extraction mechanism for storing and extracting a missile and placing the missle in an attitude for launch therefrom, the container and mechanism comprising:

an enclosed individual missile container housing;

a hinged door mounted in front of the housing;

a slide assembly mounted on the bottom of the housing and adapted for sliding outwardly from the front of the housing when the hinged door is opened;

slide assembly drive means for sliding the slide assembly outwardly from the front of the housing and retracting the slide assembly into the housing;

a launch platform mounted on the slide assembly, the platform adapted for receiving the missile thereon; and attitude means attached to the slide assembly for raising the launch platform to the proper attitude prior to launching the missile.

2. The container and mechanism as described in claim 1 wherein the slide assembly includes a pair of fixed rails mounted on the bottom of the housing and a pair of slide rails slidably mounted on the fixed rails.

3. The container and mechanism as described in claim 2 wherein the slide assembly drive means includes a drive motor with an endless chain, the chain attached to the slide rails and the launch platform for sliding the slide rails and the launch platform outwardly from the front of the housing.

4. The container and mechanism as described in claim 2 wherein the launch platform includes a cam surface in the front thereof.

5. The container and mechanism as described in claim 4 wherein the attitude means is a pair of rollers attached to the sides of the slide rails, the rollers engaging the cam surface of the launch platform for raising the launch platform to the proper attitude prior to launching the missile.

6. A missile container and extraction mechanism for storing and extracting a missile and placing the missile in an attitude for launch therefrom, the container and mechanism comprising:

an enclosed individual missile container housing;

a hinged door mounted in front of the housing;

a pair of slide rails mounted on a pair of fixed rails, the fixed rails mounted on the bottom of the housing;

a launch platform mounted on the slide rails and adapted for receiving the missile thereon, the platform having a cam surface in the front thereof;

a drive motor mounted on the slide rails and driving an endless chain attached to the fixed rails and the launch platform for moving the slide rails and platform outwardly from the housing; and a pair of rollers attached to the sides of the slide rails for engaging the cam surface in the front of the launch platform and raising the launch platform to the proper attitude when the slide rails and launch platform are moved outwardly from the front of the housing and prior to launching the missile.

7. The container and mechanism as described in claim 6 wherein the launch platform includes a missile starter motor for releasable engagement to the missile.

8. The container and mechanism as described in claim 6 wherein the launch platform includes a wing deployment mechanism for unfolding the wings of the missile when the missile is extracted from the container housing.

9. The container and mechanism as described in claim 6 further including a fuel and vent umbilical cord for releasable attachment to the missile.

10. The container and extraction mechanism as described in claim 6 further including a fly-away electrical umbilical cord for releasable attachment to the missile.

11. The container and extraction mechanism as described in claim 10 further including a missile programmer and launch controller connected to the electrical umbilical cord for permitting missile deployment, missile fueling, missile programming and autonomous launch using preprogrammed or real time generated data.

* * * * *